United States Patent [19]

Cole

[11] Patent Number: 4,818,303

[45] Date of Patent: Apr. 4, 1989

[54] METHOD AND APPARATUS FOR SETTLING SLUDGE

[75] Inventor: John M. Cole, Farmington Hills, Mich.

[73] Assignee: Kolene Corporation, Detroit, Mich.

[21] Appl. No.: 108,460

[22] Filed: Oct. 15, 1987

[51] Int. Cl.[4] ..... C21D 1/46

[52] U.S. Cl. ..... 148/20; 134/10; 134/15; 134/34; 134/122 R; 266/107; 266/120; 210/774; 210/257.1; 210/258

[58] Field of Search ..... 210/774, 804, 205, 195.1, 210/195.4, 176, 187, 179, 257.1, 258, 259, 521, 416.1, 305; 266/120, 107, 131; 148/15, 20; 134/10, 15, 34, 104, 108, 109, 122 R, 184, 182, 193

[56] References Cited

U.S. PATENT DOCUMENTS 4,078,942 3/1978 Luisi et al. ..... 266/107
4,138,273 2/1979 Lukac et al. ..... 134/10
4,149,702 4/1979 Foreman et al. ..... 266/120
4,487,398 12/1984 Lincoln et al. ..... 266/120
4,651,762 3/1987 Bowden ..... 210/523

FOREIGN PATENT DOCUMENTS 62-14004 3/1987 Japan ..... 266/120

*Primary Examiner*—Benoit Castel
*Attorney, Agent, or Firm*—William N. Hogg

[57] ABSTRACT

A method and apparatus for improved settling and handling of sludge in a fused salt bath for treating materials is provided. The apparatus includes a tank divided into a work zone and a salt processing zone, with the salt processing zone having a salt recovery section and a salt heating section. A pumping device is provided which together with adjustable gate means, generate a relatively quiescent flow in the work zone allowing sludge to settle, and a relatively turbulent flow in the salt processing zone and especially the salt heating section, to keep the sludge in suspension.

9 Claims, 2 Drawing Sheets

METHOD AND APPARATUS FOR SETTLING SLUDGE

BACKGROUND OF THE INVENTION

1. Field of the Invention

This invention relates generally to fused salt bath tanks, and more particularly to such tanks and a method of treating materials in a bath for improved settling and handling of the sludge generated.

2. Description of the Prior Art

One of the problems encountered in the process of cleaning and descaling of material in fused salt baths is the control and handling of the sludge generated by the reaction of the metal scale or other material such as paint, grease, etc. on the surface of the metal with the fused salt. This sludge normally is in the form of a fairly fine, inert granular material. When the salt bath is in a relatively quiescent, non-agitated condition, this sludge normally will settle to the bottom. However, the bath cannot normally be maintained quiescent since it is necessary to recirculate the bath past heating elements which heat the salt to maintain the temperature. During conventional recirculation, the sludge tends to stay in suspension dispersed throughout the bath due to the agitation of the recirculation. As the sludge builds up, it tends to interfere with the reaction of the material of the salt bath with the metal scale or other material on the surface of the work piece, thus reducing the efficiency of the bath action. Historically, one way to deal with this problem was to periodically stop the agitation of the recirculation and allow the sludge to settle to the bottom into a sludge pan. The pan is then removed, the sludge dumped, the pan returned, and then agitation of the bath resumed.

This method had serveral drawbacks including the accumulation of sludge during the process with attendant decreasing bath efficiency, and the necessity to shut the process down for desludging which interrupts production. Also, when the agitation is stopped, the sludge will also settle out in the region of the heating elements. These elements are not easily removable thus making more difficult the recovery of the settled sludge from the region of the heating elements. One prior art solution to this problem was to provide a separate sludge collection zone in the bath tank. This zone was maintained relatively quiescent, with moderate laminar quiescent flow of the fused salt in the sludge collection zone which allowed continuous settling of the sludge. However, this practice has a drawback in that an entire section of the tank must be dedicated solely to sludge collection, thus necessitating extra salt and with attendant additional energy costs for heating, as well as the other costs associated with larger tanks and baths.

SUMMARY OF THE INVENTION

According to the present invention, an improved salt bath treatment tank is provided. The treatment tank includes a work zone wherein material is treated in the salt bath, and a salt processing zone. The salt processing zone has a salt heating section and a salt recovery section. Pumping means are provided to pump the salt from the recovery section to the heating section, the pumping action causing turbulent flow in the processing zone. Primary adjustable gating means are provided to allow laminar flow from the heating section through the work zone and return to the recovery section. Adjustable bypass gating means are provided between the heating section and the recovery section. Means are also provided to remove settled sludge from the work zone. With this arrangement, sludge is allowed to settle out in the work zone, because of the quiescent nature of the laminar flow, and thereby minimize any interference of the sludge with the action of the salt on the work pieces. At the same time, the heating of the salt is accomplished under turbulent conditions which will maintain the sludge in suspension, thereby preventing sludge build-up in the processing zone where it would be difficult to remove. The bypass gating means are provided so that a high velocity turbulent flow can be maintained within the processing zone by means of recirculating a portion of the salt within this zone, thus allowing a lower volume laminar flow through the work zone.

DESCRIPTION OF THE PREFERRED EMBODIMENT

Figure 1:
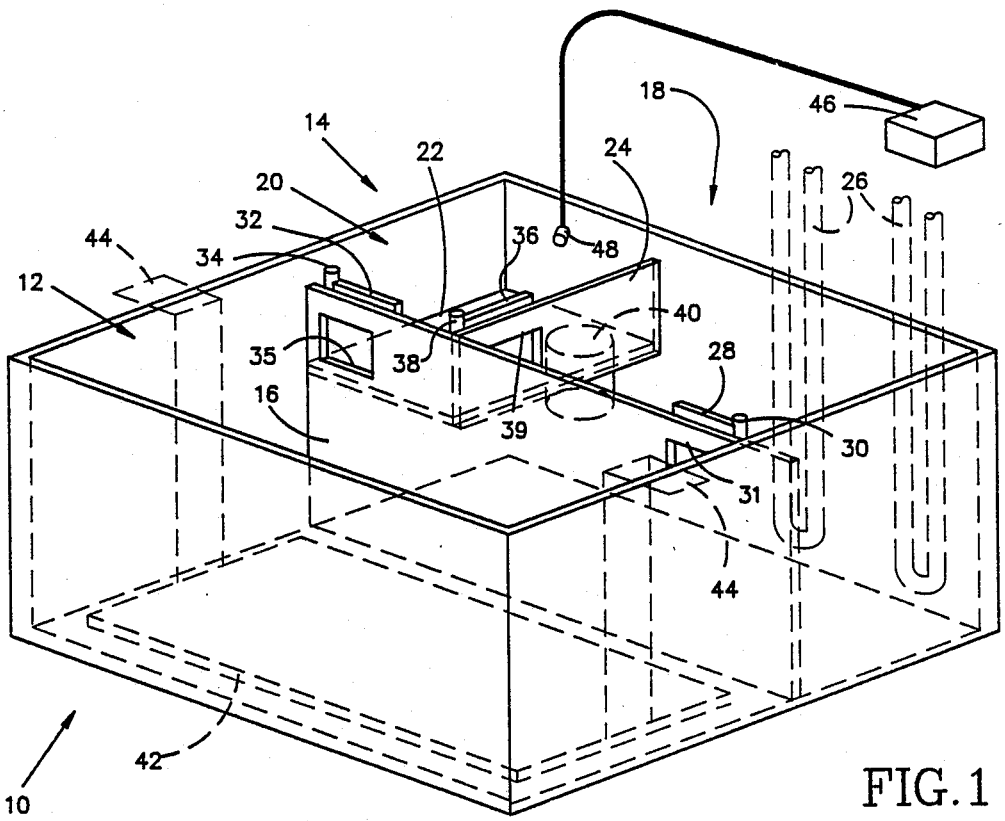
FIG. 1 is a perspective view somewhat diagrammatic of an improved salt bath tank according to this invention.
Figure 2:
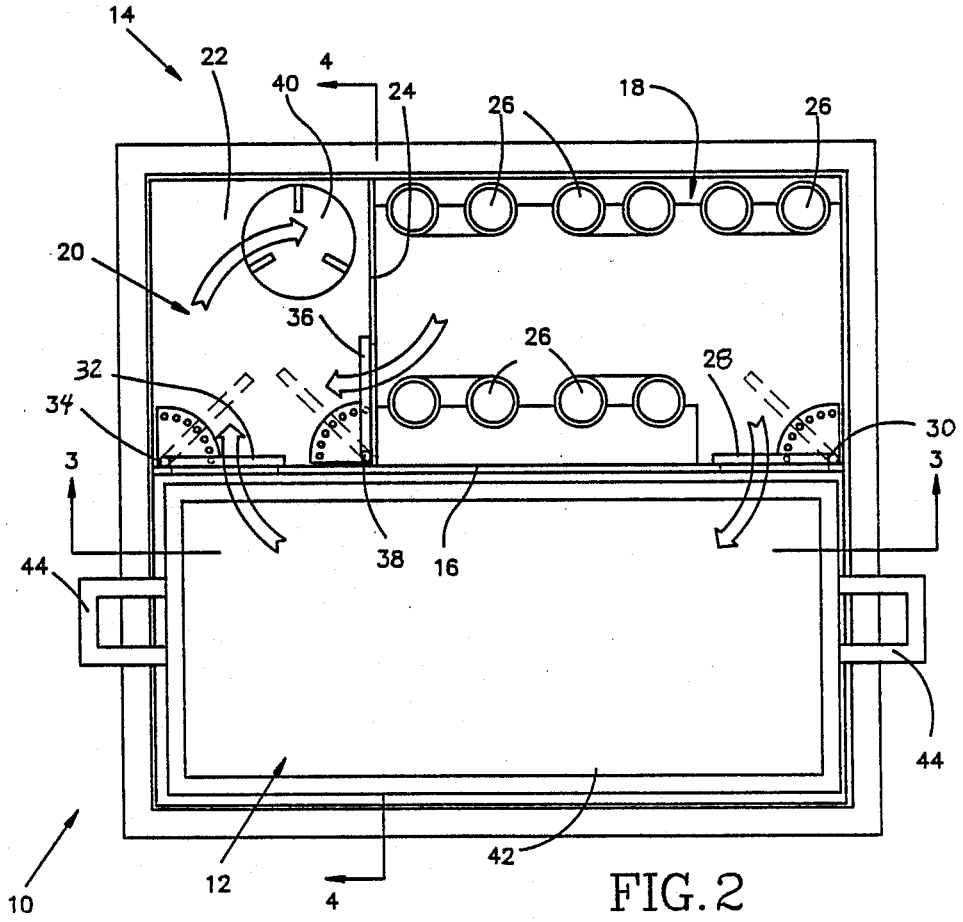
FIG. 2 is a plan view of the salt bath tank.
Figure 3:
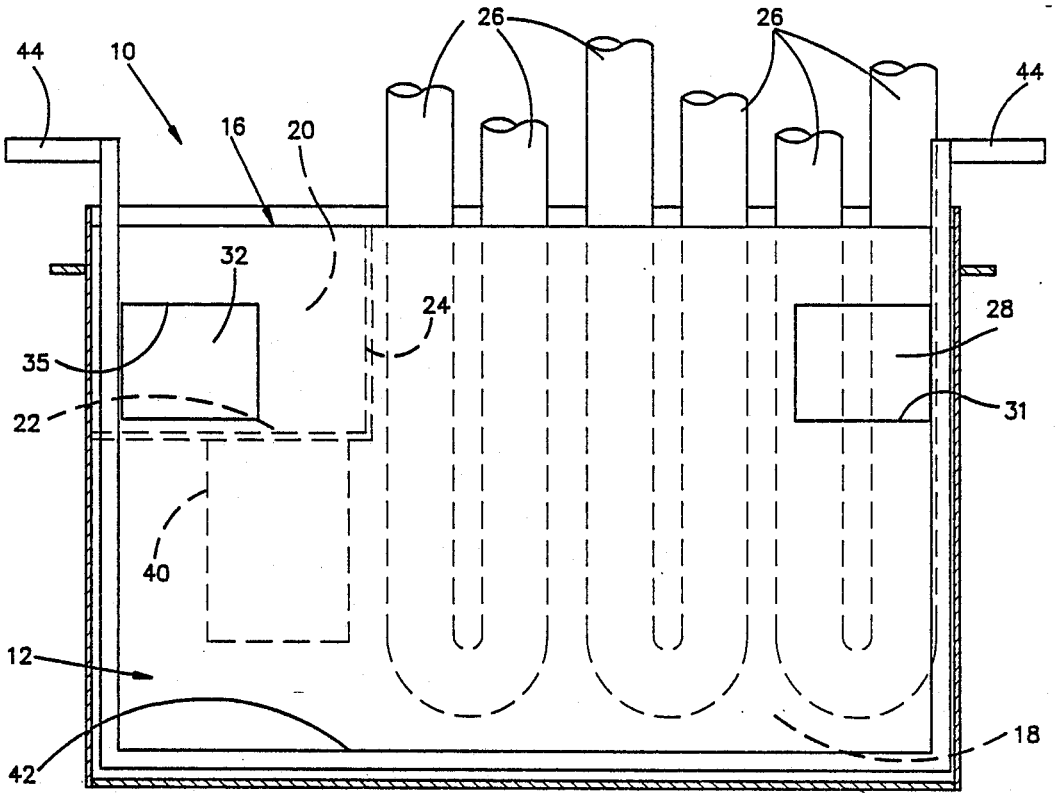
FIG. 3 is a sectional view taken substantially along the plane designated by the line 3—3 in FIG. 2.
Figure 4:
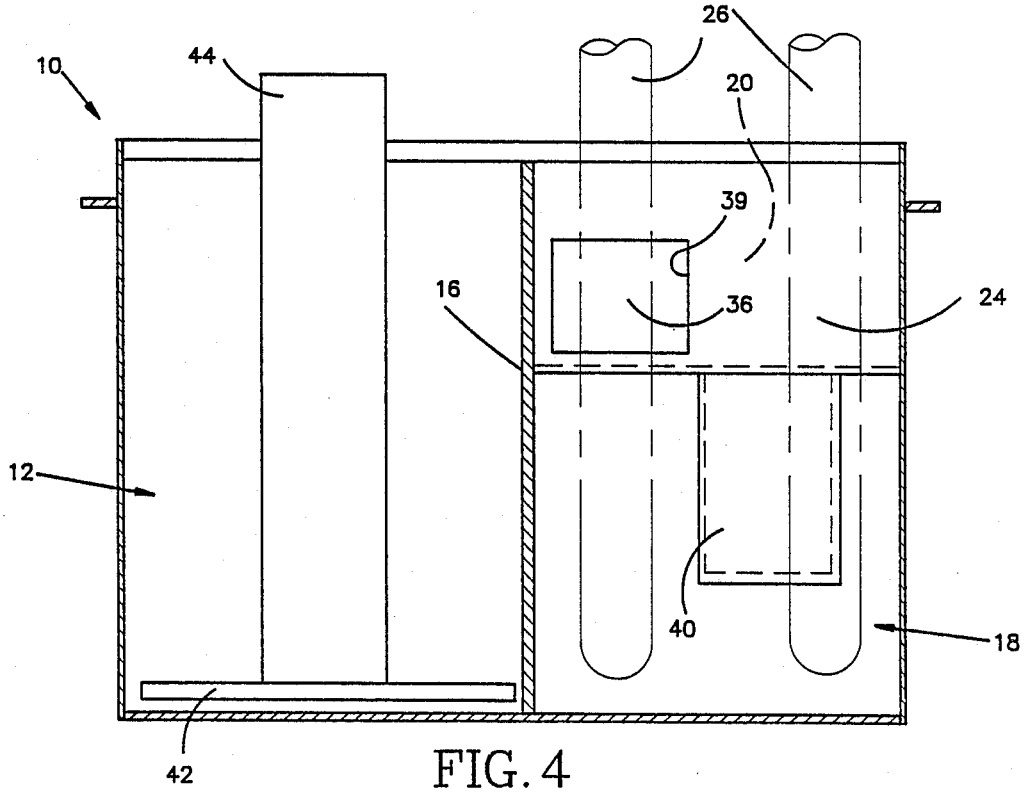
FIG. 4 is a sectional view taken substantially along the plane designated by the line 4—4 of FIG. 2.

Referring now to the drawings, an improved salt bath treatment tank 10 is shown. The drawings are somewhat diagrammatic, eliminating certain structural details not specifically relevant to the invention for the same of clarity in depicting the invention.

The tank 10 is constructed of a suitable material which is resistant to bath heat and the corrosive action of whatever salt is to be used therein.

The tank 10 is divided into a work zone 12, wherein work pieces are to be treated and a salt processing zone 14 by a partition 16. The salt processing zone 14 is further divided into a salt heating section 18 and a salt recovery section 20. The salt recovery section 20 is defined by a shelf 22 and a wall 24 extending from the partition 16 to the wall of the tank 10 along shelf 22.

Heating tubes 26 (shown in broken outline) are disposed within the salt heating section 18. These may be of any conventional design, and may be gas or electric. While the exact mountings of these heating tubes may vary with different furnace designs and applications, they all share the characteristic of being relatively difficult to remove, although removal for repair or replacement may be necessary from time to time. However, such removal is not frequent, and is time consuming and not done on a routine basis.

An outflow door 28 is mounted on pivot pin 20 and disposed to open and close opening 31 in the top of partition 16; a return door 32 is mounted on pivot pin 34 and is disposed to open and close opening 35 in the top of partition 16, and a recycling door 36 is mounted on pivot pin 38 and disposed to open and close opening 39 in the top of wall 24. The doors 28, 32, and 36 are each pivotal between fully closed positions shown in solid lines through intermediate positions to fully open positions shown in broken lines. Thus the size of the openings 31, 35 and 39 exposed and thus the amount of fluid which can flow through them can be controlled by the positioning of the doors 28, 32, and 36. The outflow door 28 regulates flow between the heating section 18 and the work zone 12, the return door 32 regulates flow between salt recovery section 20 and the work zone 12, and the recycling control door 36 regulates flow between the salt heating section 18 and the salt recovery section 20.

A recirculating pump 40 is mounted on the shelf 22, and is arranged to pump fused salt from the salt recovery section 20 to the salt heating section 18. A sludge pan 42 having handles 44 is removably disposed in the work zone 12, and can be lifted out to remove any sludge which settles therein. The burner tubes are controlled by a control device shown in block diagram 46, responsive to a thermocouple 48 disposed in the salt recovery section 20.

OPERATION

The tank 10 is filled with the desired fused salt for whatever metal cleaning treatment or metal descaling is to be performed. The heating tubes are controlled by the control device 46 responsive to the temperature of the bath as sensed by the thermocouple 48 to provide the desired temperature, this heating being necessitated by heat loss due to various factors as is well known in the art. The recirculating pump 40 provides a relatively high velocity turbulent flow of the fused salt from the salt recovery section 20 to the salt heating section 18. As used herein, turbulent flow is that fluid flow which is sufficiently agitated to maintain particles of sludge in suspension. Thus this turbulent flow maintains any sludge in suspension in the salt processing zone 14. Flow of fused salt into and out of the work zone is controlled by doors 28 and 32; by varying the amount these doors are opened, the volume of flow of the salt from the salt heating section 18 to the work zone 12 through opening 31 and from the work zone 12 to the salt recovery section 20 through opening 35, the volume of flow is regulated. It is necessary to vary this flow rate based on the different requirements of various work pieces being treated in the work zone. One typical treatment is paint stripping from metal parts in a fused salt bath, such as described in U.S. Pat. No. 3,790,489, dated Feb. 5, 1974, entitled Paint Stripping Composition.

Since the flow of the work zone 12 is from opening 31 controlled by door 28, and out through opening 35 controlled by door 32, the flow within the work zone 12 of the fused salt will be laminar, or relatively quiescent. As used herein, the term laminar flow or quiescent flow means a flow sufficiently quiescent to allow suspended particles to drop out of suspension and thus to the extent that suspended particles, such as any sludge generated during descaling are present, will settle to the bottom and be collected in the sludge pan 42.

It is also possible to close off the openings 31 and 35 completely. In addition to providing an absolutely quiescent condition in the work zone 12 which provides settling of the sludge, the salt in the work zone will also drop in temperature, and a drop in temperature also promotes settling of the sludge. Hence, during periods of non-work, the doors 28 and 32 can be closed to shut off communication of the work zone 12 and salt processing zone 14.

Since the amount of flow from the salt processing zone 14 to the work zone 12 and return varies depending upon the settings of doors 28 and 32, it is necessary to provide for recirculation within the salt processing zone 14, because a relatively high volume of fluid movement is needed to maintain turbulence. Thus the setting of the recycling control door 36 allows for the controlled return of the salt from the salt heating section 18 to the salt recovery section 20 through opening 39. The action of the pump on both the recovery section 20 and heating section 18 maintains a relatively turbulent flow in both sections. However, the critical section is the heating section 18 since, as explained above, sludge build-up around the heating tubes is especially undesirable. Thus some settling in the recovery section 20 can be tolerated. the only requirement being the necessity to remove it periodically.

Thus, reviewing the operation, turbulent flow of salt flows within the salt processing section by means of the recirculating pump 40 pumping salt turbulently from the salt recovery section 20 to the salt heating section 18 (the flow of the salt is shown by the arrows) with recirculation back to the recovery section through opening 39. This turbulent flow keeps the particles in suspension around the burner tubes preventing settling of the sludge in the salt processing zone where recovery would be difficult. The salt flows in a laminar mode from the salt heating section 18 through the work zone 12, wherein work pieces are being descaled or otherwise treated. In the work zone, the particles settle to the sludge pan 42 at the bottom, which pan 42 with collected sludge can be removed periodically to dump the sludge. The salt flow is further controlled by settling the opening of the recycling control door 36, thus allowing the pump 40 to maintain its high velocity turbulent flow.

What is claimed is:

1. A salt bath tank for containing a fused salt bath to treat work pieces, wherein said treatment results in sludge that will settle out of the bath, said tank comprising a work zone and a salt processing zone separated by partition means, said salt processing zone having a salt heating section and a salt recovery section, means to circulate said salt between the recovery section and the heating section with a turbulent flow at least in said heating section, heating means in said heating section, adjustable bypass gate means to control the flow of salt from the heating section to the recovery section; and adjustable primary gate means associated with the partition means to provide laminar flow in said work zone from said heating section through said work zone to said recovery section, thereby causing sludge to settle in said work zone while allowing treatment of work pieces by salt essentially free of sludge and maintain turbulent flow of the salt in the heating section to prevent sludge from settling in the heating section, and means to remove sludge from said work zone.

2. The invention as defined in claim 1, wherein the means to circulate salt includes pump means to pump fused salt from said salt recovery section to said salt heating section.

3. The invention as defined in claim 1, wherein the bypass gate means includes an opening and door means associated with said opening to adjust the flow volume through said opening.

4. The invention as defined in claim 1, wherein there is a first opening in said partition between said work zone and the salt heating section and a second opening between said work zone and said salt recovery section, and adjustable door means associated with at least one of said openings to control the volume of flow through said work zone.

5. The invention as defined in claim 1, in herein said means to remove sludge includes pan means removably disposed in said work zone to catch settling sludge.

6. A method of treating work pieces in a fused salt bath in which said treatment results in sludge which will settle out of the bath comprising, providing a fused salt bath in a tank having a work zone and a salt processing zone, said salt processing zone having a salt heating section and a salt recovery section, heating said salt in said heating section, providing recirculating flow of the salt between the recovery section and the heating section within the processing zone, the flow at least in the heating section being turbulent, providing laminar flow of salt form said heating section through said work zone and back into said recovery section, thereby settling sludge in said work zone while allowing treatment of the work piece with the salt essentially free of sludge and preventing sludge from settling in the processing zone.

7. The invention as defined in claim 6, wherein the flow of salt to the work zone is periodically ceased to increase settling of the sludge.

8. The invention as defined in claim 6. wherein the temperature of the salt in the work zone is periodically reduced to increase settling of the sludge.

9. The invention as defined in claim 6, wherein the flow of salt of the work zone is periodically ceased and concurrently the temperature of the salt in the work zone is lowered to increase settling of the sludge.

* * * * *